US006842931B2

(12) United States Patent
Porat et al.

(10) Patent No.: US 6,842,931 B2
(45) Date of Patent: Jan. 18, 2005

(54) SUBMERSIBLE POOL CLEANER WITH INTEGRAL RECHARGEABLE BATTERY

(75) Inventors: Joseph Porat, North Caldwell, NJ (US); Igor Fridman, Natania (IL)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 10/218,070

(22) Filed: Aug. 12, 2002

(65) Prior Publication Data

US 2004/0025268 A1 Feb. 12, 2004

(51) Int. Cl.[7] ..... E04H 4/16
(52) U.S. Cl. ..... 15/1.7
(58) Field of Search ..... 15/1.7; 29/596, 29/597, 598

(56) References Cited

U.S. PATENT DOCUMENTS 4,962,559 A * 10/1990 Schuman ..... 15/1.7
5,128,031 A * 7/1992 Midkiff ..... 15/1.7
6,299,699 B1 * 10/2001 Porat et al. ..... 15/1.7

* cited by examiner

*Primary Examiner*—Randall Chin
(74) *Attorney, Agent, or Firm*—Abelman, Frayne & Schwab

(57) ABSTRACT

A submersible robotic pool cleaner is provided with an integral sealed rechargeable battery and an inductive charging assembly, a first portion of which is mounted in the pool cleaner housing and during the charging, receives a second separate portion that is connected by a cable to a conventional power source. The pump motor drive shaft is treated with a specialized anti-friction lubricant composition to minimize frictional energy losses where the shaft contacts the seal(s) and any shaft bearing(s), to maximize efficiency and minimize the power consumption of the pump motor assembly and permit the pool cleaner to completely traverse the surfaces to be cleaned within the fully-charged power capacity of the battery.

15 Claims, 6 Drawing Sheets

SUBMERSIBLE POOL CLEANER WITH INTEGRAL RECHARGEABLE BATTERY

FIELD OF THE INVENTION

This invention relates to robotic, self-propelled submersible pool and tank cleaners.

BACKGROUND OF THE INVENTION

Conventional robotic pool cleaners are powered by electric drive motors and/or water pumps that receive power from a power cord or cable that is attached to a low-voltage power source outside of the pool. The use of a battery or batteries as a power source has also been proposed. For example, a rechargeable battery in a waterproof or water-resistant floating case having a power cable extending to the submerged pool cleaner has the advantage of eliminating or substantially reducing problems associated with twisting of the power cable which occurs with a remote stationary power supply unit as the pool cleaner traverses the bottom of the pool in its cleaning pattern.

Although the inclusion of one or more batteries in the submersible pool cleaner housing has been proposed, the limitations of battery life and power consumption have prevented the realization of a practical commercial pool cleaner having an integral battery as the sole source of power that is required for cleaning a residential swimming pool. As used herein, the term "integral battery" means a battery that is secured to the moving pool cleaner, preferably on the interior of the housing, and is to be distinguished from a battery that is tethered to the moving pool cleaner as by a power cable extending away from the pool cleaner to a floating battery housing, or an otherwise remotely positioned battery.

As previously proposed, an integral battery lacks sufficient power to complete cleaning patterns known to have been disclosed or used by the prior art. Furthermore, while a floating battery has some apparent advantages, battery power is required to overcome hydrodynamic forces resulting from moving the battery housing through the water by the tethering power cord.

A robotic pool cleaner utilizes one water pump assembly to draw water through an internal filter. The pool cleaner can also have at least one drive motor that is utilized to move the cleaner across the surface(s) to be cleaned. Typically, the drive motor that is linked through mechanical drive means has a relatively lower power consumption, as compared to the power consumed by the pump motor.

The motion of the pool cleaner can be directed from the motor through a drive train to a generally cylindrical cleaning brush which contacts the surface of the pool to be cleaned or to a rotating axle that causes the movement of one or more wheels or endless tracks which support the pool cleaner. A jet of water can also be discharged from a port at approximately a right angle to the surface over which the pool cleaner is moving in order to maintain the pool cleaner, which is conventionally of nearly neutral buoyancy, in the appropriate orientation for cleaning.

As will be understood by one of ordinary skill in the art, the pool cleaner can also be powered by a jet of water that is alternatively discharged in opposing directions that are generally parallel to the surface being cleaned to cause the cleaner to move first in one direction and then in the opposite direction. With this arrangement, it is possible to eliminate the drive motor and drive assembly, thereby reducing the overall power consumption of the pool cleaner.

It is also well known in the art to provide the pool cleaner with a pre-programmed microprocessor and electronic control device, which can include a controller and memory device that is wired to one or more electronic and/or electro-mechanical switches, sensors and the like, in order to insure that the pool cleaner follows a pattern that provides for the cleaning of the entire bottom surface of the pool. In some cases, the programmed movement is entirely random and can take account of pools of different sizes and shapes. Other pool cleaner control devices are based upon the initial orientation of the cleaner after it encounters a sidewall of a rectilinear pool having no obstacles or accessories that might impede or trap the pool cleaner, or otherwise interfere with a regular transverse repetitive movement that is designed to pass the cleaner over the entire bottom surface of the pool.

It is therefore an object of the present invention to provide an improved swimming pool cleaner having an integral battery that is capable of cleaning an entire swimming pool without recharging.

It is a further object of the invention to provide a robotic swimming pool cleaner having an integral battery and no external wires or connections leading to accessories outside of the pool.

Another object of the invention is to provide an automatic program controlled robotic pool cleaner that is powered by an integral battery that is simple and economical in its construction and which can complete the cleaning of the bottom surface of the residential pools without interruption or recharging of the integral battery during the cleaning operation.

It is a further object of the invention to provide an improved programmed electronic integrated circuit device that provides for an efficient pattern of movement for a pool cleaner having an integral battery during the cleaning of the bottom surface of a swimming pool.

SUMMARY OF THE INVENTION

The above objects and other benefits and advantages are achieved by a pool cleaner of the present invention that comprises a rechargeable integral battery that is connected to (1) a water pump associated with a cleaning filter; and (2) drive means for advancing the pool cleaner. In order to provide for the power requirements, the water pump seals and related impeller assembly and bearings operate at a high efficiency, i.e., with a low power loss to friction. A highly efficient water pump assembly is necessary to ensure sufficient electrical power from the integral battery to accomplish the cleaning of a relatively large pool.

In accordance with the method and apparatus of the present invention, it has been found that the power requirements of the water pump assembly can be reduced from an average of about 4.5 amps to about 1.0 amp. This reduction in the pump motor power requirement is directly attributable to the reduction of frictional forces on the pump drive shaft by the seals and/or bearings. The effect of reducing the frictional forces is that a smaller battery having the necessary power storage capacity can be integrated into the construction and operation of the pool cleaner.

The reduction in friction losses is achieved by coating and treating the drive shaft of the pump assembly with a friction-reducing compound of the type that is commercially available for use in automotive crankcase applications.

The sealed rechargeable battery is preferably a 12-volt lead-acid or lithium type that is rated for at least four ampere-hours of service.

In order to avoid any potential hazards, the battery is also connected to an inductive recharging circuit which itself is sealed and fitted with an inductive charging element. The employment of an inductive charging circuit eliminates the need for any exposed metallic conductors, which adds to the overall safety of the pool cleaner and its charging accessory. Although charging would not customarily be undertaken while the unit is in the water, in the event that the inductive charging element is mated in the charging position and the pool cleaner inadvertently pushed into the water, no shock hazard would arise.

In a preferred embodiment, an induction coil is utilized in the inductive charging circuit. In this embodiment, the inductive charging unit comprises a port and separate power element.

The inductive charging port is preferably located in an aperture in the pool cleaner housing. The sealed toroidal element is fixed in the housing aperture at a location that provides a convenient position to receive the mating inductive electrical element. The mating of the two elements can include a friction fit between the plastic surfaces of the respective elements, e.g., an O-ring, alone or in combination with a positive locking engagement, such as a lug and channel, or the like.

In a further preferred embodiment of the invention, the impeller attached to the pump drive motor is in the form of a propeller which provides a relatively large volumetric water flow at a relatively low pressure and requires less power consumption than other well-known alternative types of impellers, such as centrifugal and turbine pumps.

The electrical circuit is provided with a switch, either automatic or manual, to isolate the battery during charging and when the cleaner is not in use. A further preferred embodiment of the invention provides for an automatic shut-off of the power supply when the pool cleaner is removed from the water. A sensor and switch circuit are provided that interrupt the power supply from the battery. The sensor and switch can include a float mechanism, a circuit element that is non-conductive when not immersed in, or in contact with water, or a light sensing element that is mounted on the exterior of the housing and is actuated to interrupt the battery power circuit when the sensor detects the relatively brighter ambient light when the unit is removed from the water.

A sealed, waterproof rechargeable battery suitable for use in the improved pool cleaner of this invention can be purchased from the Panasonic Corporation and is identified as model LCR 12V4BP. Other suitable commercial equivalents are readily available from Panasonic and other manufacturers.

As will be understood by one of ordinary skill in the art, the electric pump motor and drive motor(s) are sealed in waterproof housings to which the electrical conductors are attached. The drive shaft is passed through the aperture of a shaft seal that typically has a torroidal spring that applies the radial sealing force on the axle. In a typical pool cleaner, it has been found that the power consumption during operation of the sealed pump motor assembly is in excess of 4.0 amperes/hour.

In order to obtain the maximum reduction in frictional forces using the anti-friction composition and lubricant, the water pump motor drive shaft is treated in at least those portions that contact the pump seals, and preferably any other contact or bearing surfaces that support the pump shaft. As a practical matter, it is most efficient from a production standpoint to treat substantially the entire surface of the pump shaft prior to its assembly.

As used herein, the term "lubricated shaft" means a pump or drive motor shaft that has been lubricated to substantially reduce the frictional forces as compared to a shaft that has not been so lubricated.

One product that has been found suitable for use in the practice of the invention is sold under the trademark REVERUP. Information on the purchase of this product is available on the Internet at www.rev_er_up.com.data.htm. Another product that is suitable for use in the invention is sold as "Nilsen's Oil Fortifier". Other suitable products are sole in retail automotive supply stores as high efficiency crankcase lubricant additives. Such additives can include tetrafluoroethylene (TFE), fluorocarbon polymers and/or fluorinated ethylene-propylene (FEP) resins and like products that are known to significantly reduce the coefficient of friction between moving surfaces.

The method of treatment is as follows:

1. the pump motor shaft is heated to about 40° C.;
2. the lubricant composition is applied as a liquid;
3. the shaft is heated to a temperature of about 80° C.; and
4. the shaft is allowed to cool to ambient temperature prior to its assembly in the pump motor housing seal(s).

Optionally, the drive motor shaft can be similarly treated with the anti-friction lubricant composition to further reduce the overall power consumption. However, the drive motor typically requires about one ampere-hour of power, which is a relatively low requirement.

It is to be understood from the above description that more than one battery, as well as more than one drive motor and/or pump motor can be utilized in the method and apparatus of the invention.

BRIEF DESCRIPTION OF THE DRAWINGS

The invention will be further described below and with reference to the drawings in which.

DETAILED DESCRIPTION OF A PREFERRED EMBODIMENT

Figure 1:
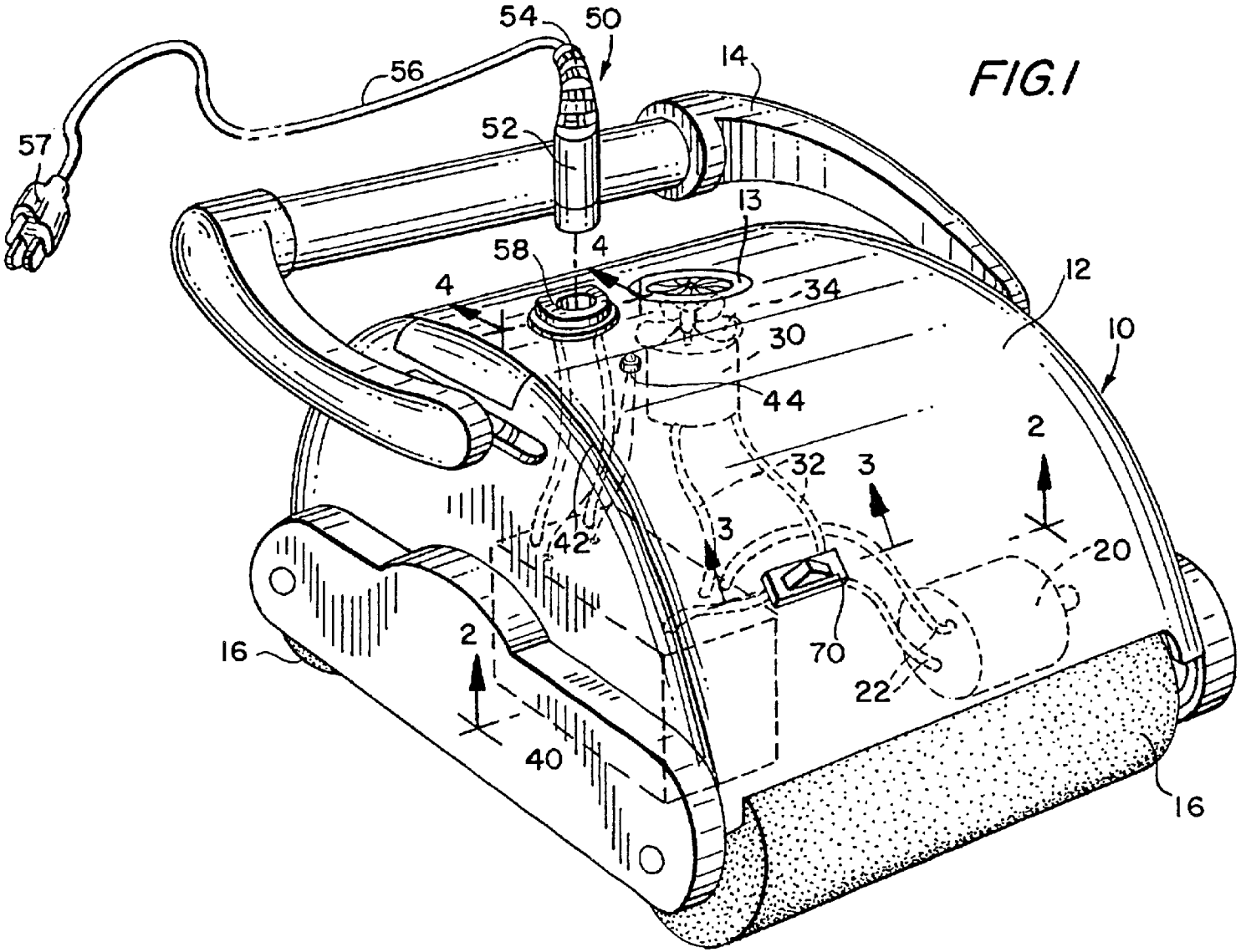
FIG. 1 is a top, front perspective view, partly in phantom, illustrating one preferred embodiment of the invention.

With reference to FIG. 1, a pool cleaner referred to generally as 10 includes an exterior housing 12 fitted with a pump outlet 13 and carrying handle 14. Rotating supports or drive means 16, in the form of cylindrical cleaning rollers, support and move the pool cleaner across the bottom or side wall surfaces of the pool to be cleaned. A sealed electric drive motor 20 is connected to drive means 16 through a power train (not shown). Drive motor electrical leads 22 are connected to battery 40.

With continuing reference to FIG. 1, a sealed electric pump motor 30 is connected to a propeller type impeller through drive shaft 33. The pump and its impeller are mounted in axial alignment with the exhaust port 13 mounted in housing 12.

The pool cleaner housing 12 also encloses a filter medium through which the water is drawn from the underside of the cleaner and discharged by the movement of impeller 34 through the discharge port 13. Other various types of water pumps and/or impellers that have been utilized in prior art pool cleaner, the preferred impeller for use in the present invention is of the propeller type. It has been found that this type of impeller provides the most efficient force for moving the desired large volume of water through the pool cleaner filter to provide an effective cleaning. Other types of impellers, e.g., turbines, create a higher pressure discharge, move to a relatively smaller volume and consume more power.

During the assembly of the pump motor in its waterproof housing, the shaft is treated as described above with the friction-reducing lubricant either along its entire length or at those positions which contact the seals. If the shaft is mounted in bearings outside of the motor housing, that portion of the shaft is also preferably treated with the friction-reducing lubricant. This treatment has the effect of substantially reducing the power consumption of the pump motor. In operational tests, the power consumption was reduced by as much as about 75%, so that the water pump's power consumption was reduced from about four amps to about one amp.

As will be apparent to one of ordinary skill in the art, the significant reduction in power consumption resulting from the practice of the invention extends the operating time of the pool cleaner by almost four times. The power consumption of the drive motor is relatively much less than the power consumed by the water pump when operated under conventional prior art conditions and without the treatment of the water pump drive shaft with the friction-reducing lubricant. However, the invention comprehends the use of a lubricated shaft to minimize frictional losses.

A further beneficial effect of this reduction in power consumption is to permit the installation of a battery in the interior of a pool cleaner housing that is within the parameters of size and weight that will permit the pool cleaner to be lifted, moved and stored much in the same way as a cleaner of the prior art which receives its power from an external source, i.e., a conventional electric current supply. The size and weight of the battery must also be considered in maintaining the negative, but near-neutral buoyancy of the cleaner.

With continuing reference to FIG. 1, there is also shown an inductive charging assembly 50 that comprises an inductive recharging circuit that includes elements that are sealed and waterproof, and that operate at a relatively low voltage. An inductive charging port 58 is securely mounted through an opening in housing 12. The port includes a pair of electrical conductors 42 that enter the sealed battery case 40 and are secured to the battery charging circuit (not shown).

A separate power charging element 52 mates with charging port 58 in the charging configuration. Sealed charging element 52 is connected through a power cable 56 to a conventional electrical plug 57. In a preferred embodiment, the charging element 52 includes a flexible and wear-resistant collar 54 to preclude damage and the loss of the water-tight seal with power cord 56. The charging element 52 or the port 58 can be provided with a plurality of frictional ribs, an O-ring, or other construction to maintain proper alignment and a secure fit between these members during charging.

During battery charging, the pool cleaner is preferably removed from the water and placed away from the pool. However, as will be appreciated by one of ordinary skill in the art, the inductive charging assembly provides a means for recharging the battery that avoids the need for any exposed metal conductors that might lead to an electrical shock or other injury in the event that the pool cleaner is accidently or inadvertently placed in the pool during charging. In fact, the inductive element 52 can be handled even when the plug 57 is in a power socket.

The materials of construction of the charging port 58 and mating charging element 50 are preferably selected from the class of impact-resistant, non-conducting polymers that are resistant to UV radiation and chemicals commonly used in treating the water in the pool.

In a particularly preferred embodiment, the pool cleaner is also provided with a light-emitting indicator that is visible during the battery charging to provide information on the condition of the battery's charge. In an especially preferred embodiment, the indicator 44 is a light-emitting diode or similar device mounted on the external surface of the housing 12 or otherwise positioned adjacent an aperture in the housing that will permit the user to determine when the battery is fully charged. Leads 42 extend to the battery 40. In an alternative embodiment, a manual or automatic shutoff switch can be provided in the circuit between the external power source and the battery to discontinue the charging current to induction element 50 when the battery has reached the desired level of charge.

As will also be understood by one of ordinary skill in the art, the particular arrangement of the drive motor, battery, pump motor, switch and their associated electrical conductors 32 can be varied. Although the preferred embodiment of the invention positions the battery on the interior of the housing in order to minimize turbulence and other hydrodynamic frictional effects, the battery can be secured in a position which is external to, but attached securely in a fixed position to the housing 12. For example, the housing, typically formed of molded plastic, can be provided with an integral external receptacle or brackets (not shown) for receiving the battery. In any event, it will be understood from the definition provided above, that the battery is an integral part of the pool cleaner whether mounted on the exterior or interior of the housing.

Figure 2:
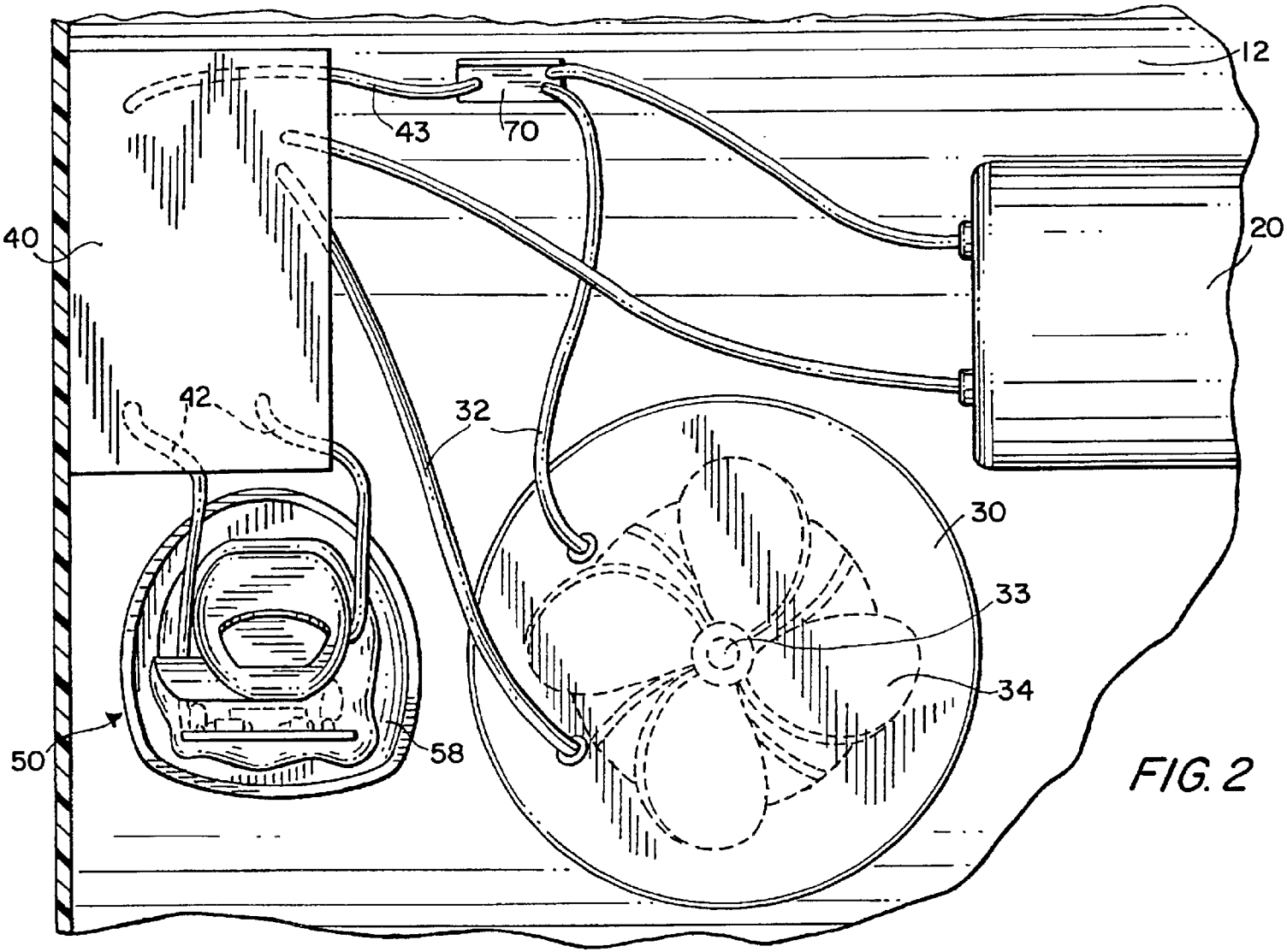
FIG. 2 is an enlarged interior view, partly in section, of a portion of the pool cleaner of FIG. 1.

As best shown in FIG. 2, switch 70, mounted in housing 12, is connected on one side to the battery and at the other side of the switch separate leads 32 extend to the drive motor and pump motor.

Figure 3:
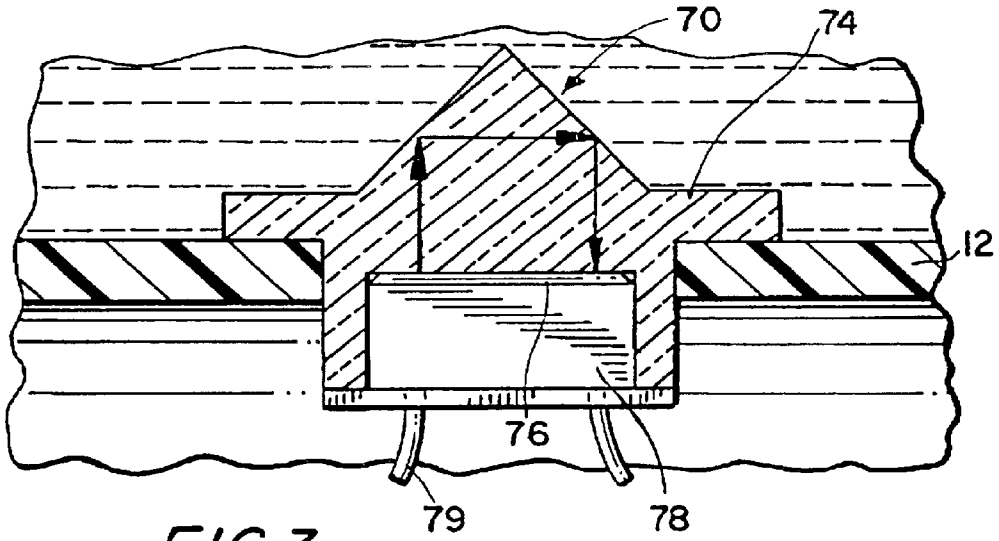
FIG. 3 is an enlarged cross-sectional side view of the light sensor switch shown in FIG. 1.

In a particularly preferred embodiment, as illustrated in FIG. 3, the switch 70 includes an optical sensor in housing 74 that receives ambient light that is transmitted to a photovoltaic element 76 that is in turn linked to the electronic switching device in housing 78. When the pool cleaner is submerged, the ambient light is at a relatively low level and the switch is in the closed position allowing power to pass through conductor 79 to the pump and drive motors. When the pool cleaner is removed from the water, the ambient light increases and the photovoltaic layer responds by sending a signal to open the switch and terminate the power transmitted to the two motors.

In a further preferred embodiment, the switch 70 can include a light-emitting source in element 78, which light is reflected internally in the sensor housing 74 to a photovoltaic receiving surface 76. While the pool cleaner and sensor are submerged, the optical reflectivity within the sensor is such that the switch is maintained in the closed position and power flows from the battery to the respective motors. When the sensor is removed from the water, the reflectivity is reduced and the light emitted escapes from the housing and the switch circuit is opened so that power flow is discontinued.

Various other types of switches, including a simple manual toggle switch, can be installed to permit the user to turn the motors on and off. A float switch can also be employed, so that when the pool cleaner is removed from the water, the buoyant portion of the switch changes position and the circuit is opened, thereby terminating the power flow from the battery to the motors.

Figure 4:
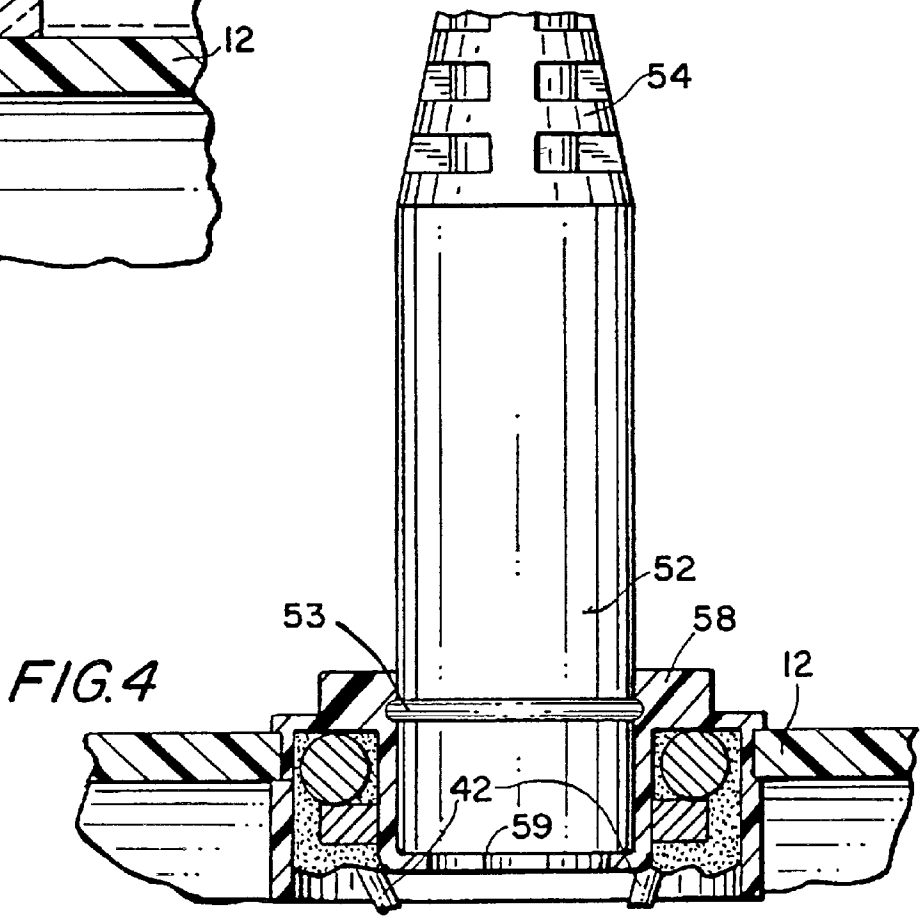
FIG. 4 is a side view, partly in section, illustrating the induction charging assembly on the mated configuration for charging the pool cleaner battery.

Referring now to FIG. 4, the inductive charging element 52 is shown positioned in the annular chamber of port 58 for receiving the charging current that is directed to the battery. The underside of the port member is provided with leads 42 which, as best seen in FIG. 2, are connected to the charging circuit of the battery 40. The charging element 52 can optionally be provided with an o-ring 53 to assure a secure and stable fit in the annulus 59 during charging.

In order to maximize the capability of the robotic cleaner to cover the entire bottom surface of the pool to be cleaned, the unit is provided with a microprocessor that has been programmed to direct the cleaner in a particularly efficient pattern of movements. The programming and installation of microprocessors and controllers is well known in the art.

In a particularly preferred embodiment, the on-board microprocessor is programmed with an algorithm that results in the following cleaning pattern:

1. Following initiation, the unit traverses the pool to encounter a wall, after which it reverses to cross to the opposite side wall.
2. After each crossing, the unit reverses, travelling a predetermined distance back along the same path.
3. When the predetermined distance is reached, the unit turns a predetermined angle, which can be about 90°, and advances to reach a side wall.
4. Thereafter, the unit reverses and traverses the bottom to the opposite side wall.

The pattern of returning a predetermined distance along the most recent path and then stopping to turn a predetermined angle is repeated. The counter records the number of contacts with the side walls. After a predetermined number of such side wall contacts have been recorded, the predetermined distance of the reverse leg travel is altered and the routine is continued until the entire bottom area of the pool is contacted and cleaned.

Figure 5:
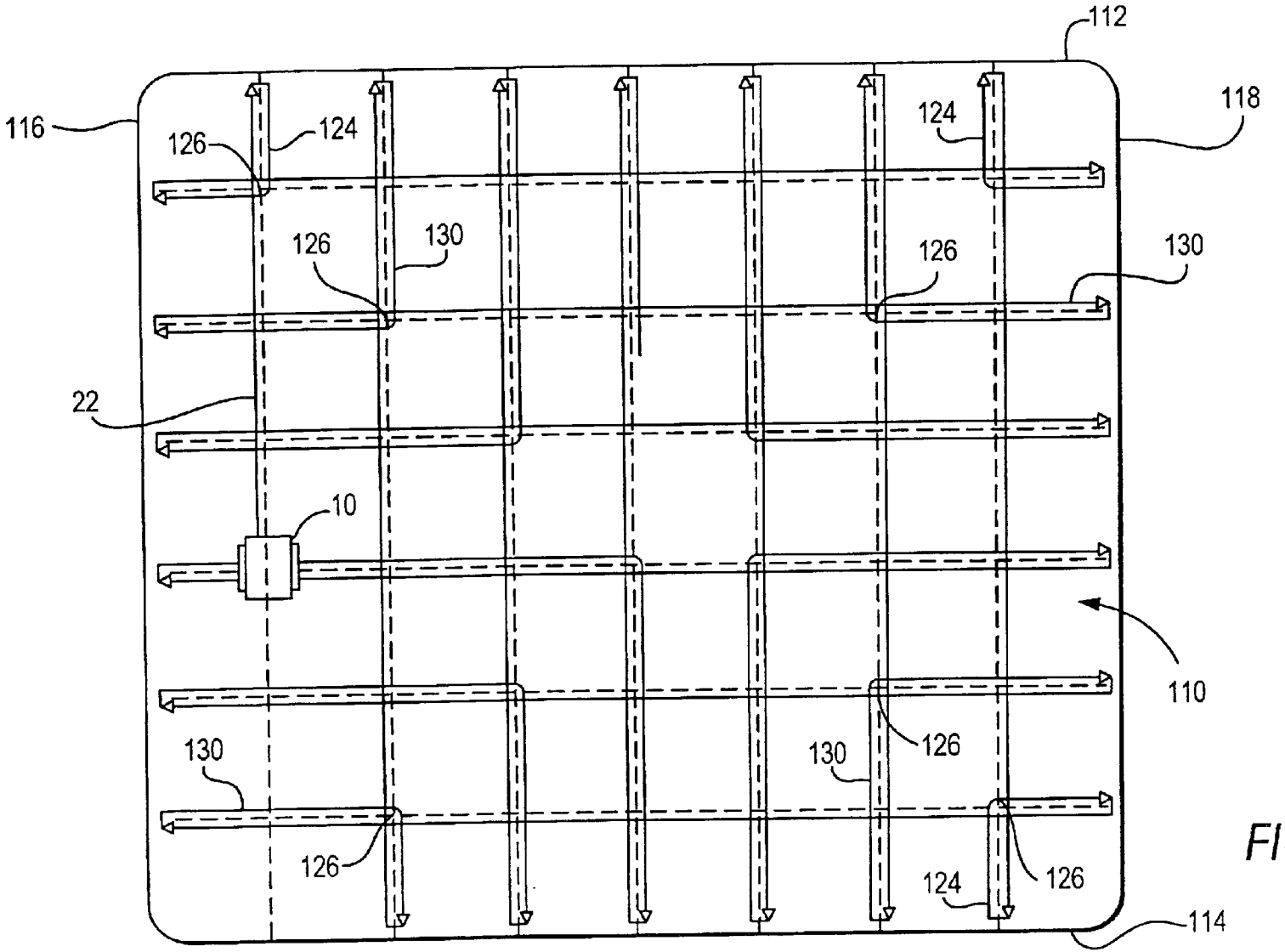
FIG. 5 is a schematic plan view of a typical rectangular pool illustrating the programmed movement of the cleaner on the bottom wall in accordance with one preferred embodiment of the invention.

An example of this preferred programmed pattern is schematically illustrated in FIG. 5. In order to more clearly depict the cleaning pattern, parallel lines are used to illustrate the reverse leg portion. However, it will be understood that the actual path followed by the unit will overlap along the dashed lines. The lines with the arrowheads represent the direction of travel of the unit. The angle of rotation illustrated is 90°.

In a particularly preferred embodiment of the present invention, a novel algorithm that we have developed is incorporated into a microprocessor controller that directs the automated pool cleaner in its cleaning pattern. The novel cleaning pattern is the subject of co-pending patent application entitled "Pool Cleaning Method and Apparatus" filed Jul. 29, 2002 naming Porat and Fridman as inventors, and the disclosure of this co-pending application is incorporated herein in its entirety by reference.

In its broadest construction, the improved method is practiced in accordance with the step-wise procedure that follows.

In this embodiment of the invention's apparatus and method for cleaning the surfaces of a pool, an automated cleaner capable of reversing movement and turning is utilized. The unit is initially placed at an arbitrary location on the bottom of pool 110, and the method comprises moving the cleaner in a forward direction until it encounters an upright pool wall 112, reversing the robot until it is a predetermined distance 124 from the wall 112, turning it through a predetermined angle 126 that is less than 180°, and preferably 90° for a rectilinear pool, and continuing to move it until it again encounters an upright wall 116, and then repeating those steps until the unit has encountered upright walls e.g., 118, 112, 114, 118 a predetermined number of times, at which point the predetermined distance is changed e.g. to 130. All of the previous steps are repeated again until a substantial area of the pool floor 110 has been covered. In a preferred embodiment, a rectangular pool is cleaned by setting the turning angle to 90° and the number of turns before changing the predetermined distance from 125 to 130 is seven.

In another aspect of the invention, the robot has a propeller-type impeller driven in a horizontal plane, and the robot is turned by interrupting motive force to the impeller a plurality of times during a predetermined period to impart a sideways directed bias momentum to the robot.

Figure 6:
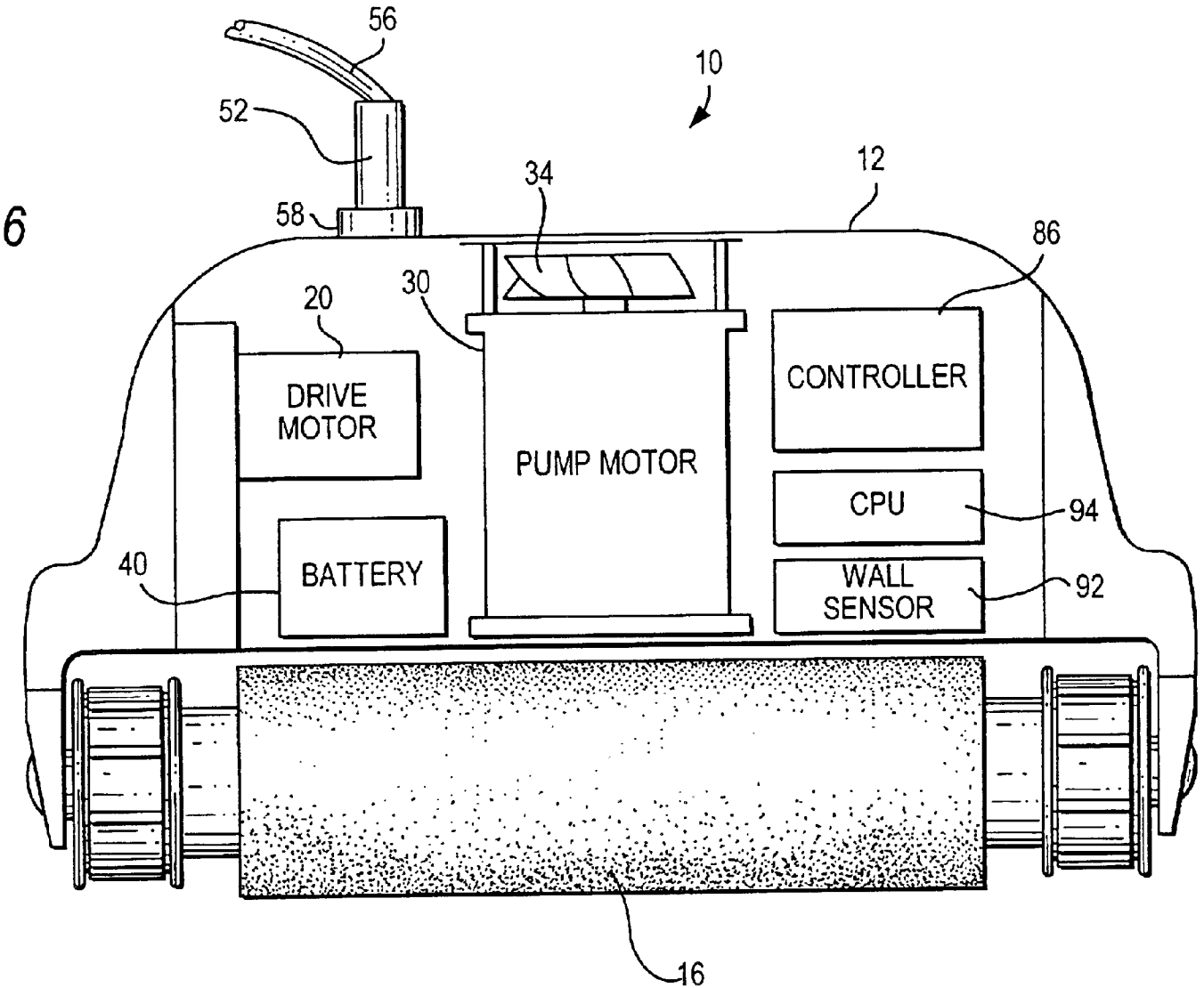
FIG. 6 is an end elevation view, partly in section schematically illustrating the components in the cleaner housing.

A schematic illustration of the arrangement of elements in the interior of the pool cleaner housing is shown in FIG. 6. The particular position of the controller 86 and central processing unit (CPU) 94 of the microprocessor 80 is not critical. Likewise, the location of the wall sensor 92, schematically illustrated in FIG. 6, will be understood by one of ordinary skill in the art to be comprised of one or more components located with transmitting/receiving elements located at either end of the unit. Such sensors can be mechanical or electromechanical, but are preferably electronic, e.g., infrared transmitters which receive signals reflected from the pool's side walls. The cleaner can also include a ground position system (GPS) 95 with floating antenna 97 for use in gathering data on the location and way points as the unit traverses the bottom of the pool.

Figure 7:
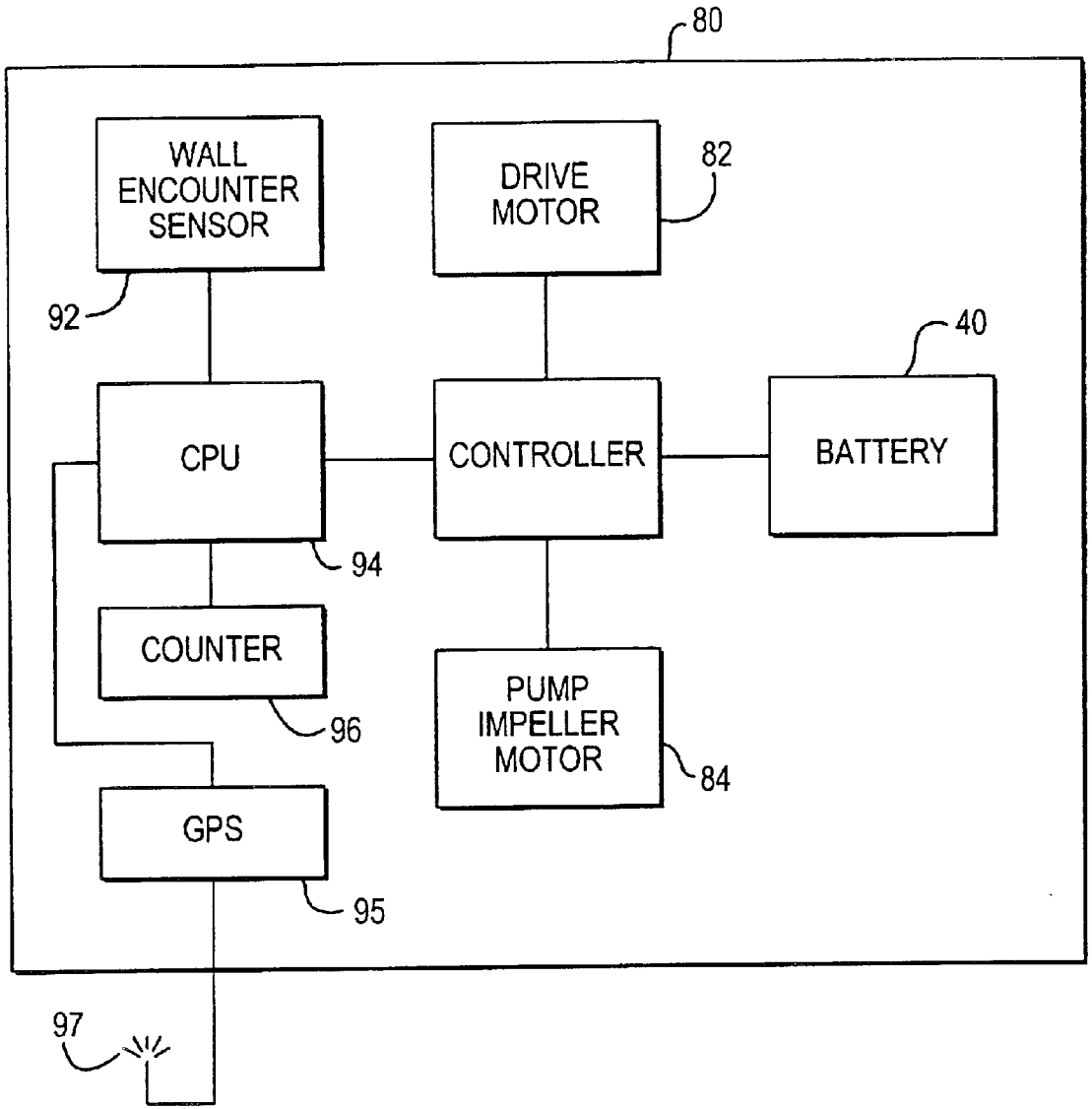
FIG. 7 is a schematic circuit diagram of the electrical components for use in one embodiment of the invention.

A schematic circuit diagram is illustrated in FIG. 7. Again, the arrangement of elements is merely illustrative and not to scale. The electronic elements, including the microprocessor CPU 94, controller 86, counter 96, and wall counter 96 and sensor 92 are preferably incorporated into a unitary waterproof housing or assembly for ease and economy of installation and replacement, should that become necessary.

Also shown in FIG. 7 is a global positioning system or "GPS" unit 95 that is also in communication with the CPU and controller. The utilization of GPS units with marine and aircraft navigational systems is well known in the art. It is within the skill of the art to integrate the control of the pool cleaning unit based on the algorithm with a starting set of coordinates provided by the GPS unit. For example, the pool cleaner can be manually positioned at one corner of the pool as prescribed by the operating instructions and the GPS coordinate entered into the controller memory. The unit can then be taken to a different location along the pool, e.g., the diagonally opposite corner of a rectangular pool and those GPS coordinates entered. The program will then have sufficient information to determine an appropriate path for the unit to follow in order to clean substantially the entire bottom of the pool.

The entry of the coordinates can be in the way of a manual push button or other similar entry device based on a programming sequence provided to the user in a user's manual. A separate hand-held device that communicates with the controller, as by IR signals or conductor wires, can be also utilized. The unit will also have to be provided with a floating antenna wire for receiving the GPS signals, or they can be transmitted through a receiver in the power supply. Once the unit is positioned on the bottom surface of the pool and activated, the algorithm that now includes the GPS coordinates can accurately direct the movement, turning and distance changes necessary to cover the entire bottom surface of the pool in an efficient cleaning pattern.

Alternate algorithms are provided for round, oval or other shaped pools. In a preferred embodiment the microprocessor is provided with a plurality of algorithms and a display or manual switch is provided to permit the seller or user to select the optimum program for the pool to be cleaned.

While the invention has been described with reference to the specific embodiments set forth above and in the drawings forming a part of this application, modifications and variations will be apparent to those skilled in the art that will fall within the scope of the claims that follow.

We claim:

1. A self-propelled, submersible pool cleaner comprising:

a) an integral sealed rechargeable battery;

b) a sealed water pump motor electrically connected to said battery, said motor having a shaft on which is mounted an impeller; and c) a waterproof sealed first portion of an inductive charging assembly electrically connected to said battery, said first portion of the inductive charging assembly being permanently affixed to said pool cleaner, said first portion of the inductive charging assembly having an aperture for receiving a sealed second portion of the inductive charging assembly adapted to be connected to an external power supply, wherein the aperture in the first portion of the inductive charging assembly receives the second portion in mating relation for recharging said battery while maintaining the first and second portions sealed.

2. The pool cleaner of claim 1, wherein the battery produces a voltage in the range of from 6 volts to 12 volts.

3. The pool cleaner of claim 1, wherein the battery is connected to the pump motor through a switch.

4. The pool cleaner of claim 1, wherein the pump impeller is a propeller.

5. The pool cleaner of claim 1, wherein the pump motor operates on twelve volts.

6. The pool cleaner of claim 1, which further comprises a housing, wherein the battery is positioned inside of the housing.

7. The pool cleaner of claim 6, which further comprises a switch mounted on said housing, whereby the power from the battery can be interrupted when the switch is moved to an off position.

8. The pool cleaner of claim 7, wherein the switch is a light-sensitive optical switch for interrupting the power to the pump and drive motors.

9. The pool cleaner of claim 7, wherein the switch is a toggle switch.

10. The pool cleaner of claim 1, which further comprises a drive motor electrically connected to the battery for propelling the pool cleaner.

11. A battery-powered submersible pool cleaner comprising a pool cleaner housing, an integral rechargeable battery secured to said housing, and a waterproof sealed inductive charging assembly, at least a first portion of which is secured to said housing and is electrically connected to the battery, wherein a sealed second portion of the inductive charging assembly mates with the first portion while maintaining the first and second portions sealed.

12. The pool cleaner of claim 11 that further includes an integral water pump and which is moved by the discharge of water from the water pump.

13. The pool cleaner of claim 11 that includes a programmed microprocessor and controller and which is programmed to move in a generally rectilinear path over the bottom surface of a pool or tank.

14. The pool cleaner of claim 11 in which the second portion of the inductive charging assembly is received in mating relation in a recess of the first portion connected to the battery.

15. The pool cleaner of claim 14 in which the second portion includes a power cable and is of waterproof construction.

* * * * *